US007316268B2

(12) United States Patent
Peleanu et al.

(10) Patent No.: US 7,316,268 B2
(45) Date of Patent: Jan. 8, 2008

(54) METHOD FOR CONDITIONING WELLBORE FLUIDS AND SUCKER ROD THEREFORE

(76) Inventors: Ion Peleanu, Aleea Compozitorilor 13-OD5, 4-138, sec. 6, Bucharest (RO); Bruno Kachele, Jahnstrasse 9, D-73235 Weilheim Teck (DE)

( * ) Notice: Subject to any disclaimer, the term of this patent is extended or adjusted under 35 U.S.C. 154(b) by 110 days.

(21) Appl. No.: 10/493,515

(22) PCT Filed: May 8, 2002

(86) PCT No.: PCT/RO02/00012

§ 371 (c)(1),
(2), (4) Date: Apr. 20, 2004

(87) PCT Pub. No.: WO03/036016

PCT Pub. Date: May 1, 2003

(65) Prior Publication Data

US 2005/0000689 A1 Jan. 6, 2005

(30) Foreign Application Priority Data

Oct. 22, 2001 (RO) ..... 01-1155

(51) Int. Cl.
*E21B 17/00* (2006.01)

(52) U.S. Cl. ..... 166/68.5; 166/105; 166/311

(58) Field of Classification Search ..... 166/311, 166/305.1, 68.5, 105; 418/48
See application file for complete search history.

(56) References Cited

U.S. PATENT DOCUMENTS 1,406,017 A * 2/1922 Holmes et al. ..... 417/257
2,639,674 A * 5/1953 Reese ..... 166/222
3,489,445 A 1/1970 Kammerer
5,088,638 A * 2/1992 Karaev et al. ..... 228/112.1
5,881,814 A * 3/1999 Mills ..... 166/313
5,924,490 A 7/1999 Stone
5,934,372 A * 8/1999 Muth ..... 166/72
6,065,944 A * 5/2000 Cobb ..... 417/394
6,604,910 B1 * 8/2003 Zupanick ..... 417/36

FOREIGN PATENT DOCUMENTS

| | | |
|---|---|---|
| EP | 0 145 154 | 6/1985 |
| EP | 0 979 922 | 2/2000 |
| WO | 01/11187 | 2/2001 |

* cited by examiner

*Primary Examiner*—David Bagnell
*Assistant Examiner*—Giovanna M Collins
(74) *Attorney, Agent, or Firm*—Andrew Wilford

(57) ABSTRACT

Invention refers to a method for conditioning wellbore fluids and to a sucker rod to accomplish the method used in the field of petroleum production. The method the invention refers to involves fact that the injection of the conditioning fluids is done directly through the sucker rods, from the surface, concomitantly pumping (producing) the well, being possible that the conditioning fluid be distributed either in the producing tubing or in the wellbore, or even in the reservoir rock around the wellbore, concomitantly pumping the well. The sucker rod designed for the application of the method is made of steel and it has two sucker rod heads (1) which are tubular, welded to the ends of a tube (2) made of steel, thus forming a continuous tube through which a fluid can flow or an electric or optical cable can be pulled through, or set inside.

3 Claims, 3 Drawing Sheets

METHOD FOR CONDITIONING WELLBORE FLUIDS AND SUCKER ROD THEREFORE

CROSS REFERENCE TO RELATED APPLICATIONS

This application is a national stage of PCT/RO02/00012 filed 8 May 2002 based upon Romanian national application of 2001-01155 of 22 Oct. 2001 under the International Convention.

FIELD OF THE INVENTION

The invention relates to a method of conditioning wellbore fluids and sucker rod to accomplish the method, used in the field of petroleum production.

BACKGROUND OF THE INVENTION

Downhole pumping of wellbore fluids is the most frequent method used for secondary recovery of crude oil in petroleum production. Downhole pumping involves procedures and devices through which the pumping energy gets to the wellbore fluids, so that wellbore fluids move up the downhole, to the surface, through production tubing. Devices used for this purpose are amongst the most diverse in the industry, though only few models have made inroads sufficient to become standardized. They are generically known as downhole plunger pumps, PCP (Progressive Cavity Pumps), ESP (Electrical Submersible Pumps), and "screw" pumps.

From a constructive stand point, the devices used for downhole pumping, no matter the pumping option per se, have the following components: a part, the driver, whereby mechanical energy is generated; another part transmitting the mechanical energy previously generated to the pump; and the pump itself. The pump transfers the mechanical energy brought from surface to the wellbore fluids, turning it into pressure of the fluids. In the oil field the electrical motor has become the device of choice in generating mechanical energy to drive the pump, though there are many applications where one may see steam driving, hydraulic or pneumatic driving as alternate options to drive the pump. Mechanical energy from the driver can be delivered to the pump either through sucker rods (in this case the driver being at the surface and the pump downhole), or can be produced and used locally. This second option is so-called "bottom hole driver" or "direct drive"; e.g. PCP pumps driven through bottom hole drivers, "screw" pumps driven through bottom hole drivers or ESP pumps driven in the same way.

In the petroleum industry, the wellbore fluids, the wellbore itself or even the reservoir rock nearby the wellbore, needs conditioning. The purpose of conditioning wellbore fluids is to control scaling (either organic or mineral) inside the production tubing, the casing or to pump, to keep the aggressivity of the wellbore fluids under control (avoid corrosion, for example) or to improve flowing properties of wellbore fluids. In order to condition wellbore fluids a conditioning agent (dilutants, solvents, steam, hot water, specialty chemicals) is added (injected) either continuously or in batches, either into the wellbore or downstream of the wellhead during pumping the well. Adding conditioning agent to the wellbore fluids is presently done through pumping. From the surface the conditioning agent is pumped through an annulus, through an injection line (in which case the injection line is set in the annulus). Pumping of the conditioning agent in the annulus is barely controllable, leading to excessive consumption of conditioning agent and poor control of conditioning. Injecting it downhole, through a separate line means costly supplementary logistics. Both disadvantages have as a starting point the actual configuration of sucker rods used to pump the well.

Conditioning the wellbore or the reservoir rock nearby the wellbore involves pumping the conditioning agents (steam, hot oil, hot water, specialty chemicals) under high pressure (injecting) into the wellbore or the pay zone, thus controlling wellbore integrity or flowing characteristics of the reservoir rock. Today, realizing this goal means that one has to shut down the well, pull out the sucker rod string, condition the wellbore or the formation, set the sucker rods string and the pump back into the well and resume production. Associated to production disruption is the production lost while conditioning the well. This means that one has to invest supplementarily in costly logistics, to do the conditioning, and both, when considered together, increased cost of conditioning as well as overall operational expenses of producing the well. The above-mentioned disadvantages have as a starting point the actual configuration of sucker rods used to pump the well.

For historical reasons, as well as because of infrastructure on site, delivering mechanical energy to PCPs or to screw pumps is done (nowadays) through the same sucker rods strings used for downhole plunger pumps. There is one major difference, though, and that has to be considered while comparing driving PCPs and "screw" pumps to plunger pumps. While transmitting mechanical energy to the pump, the sucker rods used to drive downhole plunger pumps move up and down, axially; the sucker rods used to drive PCPs or "screw" pumps rotate.

The sucker rods used in the oil field are nowadays standardized, all sucker rods manufacturers following API 11B standard (American Petroleum Institute).

Such sucker rod is a continuous full bodied metallic bar, with both e s profiled and threaded to allow end-to-end connection in a sucker rod string. The string thus made is used to transmit mechanical energy from the driver (at surface) to the pump (downhole).

Using full bodied sucker rods strings leads to extra cost, involves supplementary, costly logistics, and special operations and lost production associated with, whenever the wellbore fluids, the weilbore itself or the formation pay zone has to be conditioned, as outlined above.

Another disadvantage of using classical sucker rod/pumping technology is that it renders as expensive and non-attractive live data gathering for parameters like the bottom hole temperature and pressure, flowing properties of the weilbore fluids, or the pumping regime. Bringing the information from bottom hole transducers to the surface, while pumping the well it involves the use of special data cables inserted in the annulus between the production tubing and the production casing, and designed to stand the aggressivity of weilbore fluids, as well as the combined effect of temperature and pressure. For special purpose applications alternatives exist but they involve converting the electric signals from bottom hole transducers into ironic or electromagnetic waves beamed to the surface an option even more expensive and difficult to implement.

One may encounter similar troubles when direct drive applications are considered for PCPs, screw pumps or ESPs where the use of bottom hole electric motors is needed. Bringing the power to the bottom hole electric motors requires power cables usually inserted in the hole through an annulus and designed to stand the aggressivity of wellbore fluids, as well as the combined effect of temperature and pressure. These cables are very expensive and sometimes this renders the bottom hole direct drive technique non-attractive.

Alternative option to driving downhole pumps (no matter whether plunger, PCP, screw or ESP) has been designed and it involves the use of flexible coiled tubing instead of classical sucker rods. This option is more expensive than traditional sucker rods driving and consequently of limited use. To compound the issue, using coiled tubing means that special infrastructure must be available on site. Because of that the cost of replacing the classical sucker rods technology becomes prohibitive.

OBJECT OF THE INVENTION

The object of the invention is to provide a method to condition wellbore fluids, or the wellbore itself or the reservoir rock, concomitantly pumping the well, with a special emphasis on using the existing infrastructure in place in the oil field. To these ends devising a sucker rod designed to help achieve this task is needed.

SUMMARY OF THE INVENTION

Conditioning the wellbore fluids; the wellbore itself or the reservoir rock and concomitantly pumping the well, in accordance with this invention, involves injecting the conditioning fluid from the face into the wellbore, directly through the sucker rods. Injecting pressure of conditioning fluid will be adjusted from the surface, in accordance with the scope of injection, whether placing conditioning fluid in the tubing, or wellbore or injecting it into the reservoir rock. Through adequate devices, conditioning fluid can be distributed either in the production tubing, wellbore or injected into the reservoir rock, as needed.

The sucker rod of the present invention consists of a single continuous flowing tube made of two sucker rod heads attached by welding to both ends of a steel tube. The conditioning fluid can flow through this continuous tube, thus achieving the scope of conditioning the wellbore fluids or the wellbore and concomitantly pumping the well. The sucker rod head has a hole drilled into it. This hole is cylindrical through the whole section between the beginning of the thread of the sucker rod head, through the wrench square and the lower third height of the sucker rod bead. The hole continues conically through the rest of the sucker rod bead height and ends cylindrically in the welding section of the sucker rod head. A radius connects the conical section of the hole to the last cylindrical section, designed to function as a stress relief section.

The conditioning method presented in this invention and the hollow sucker rods for it can be applied directly in oil field pumping applications using the infrastructure and logistics available on site to handle traditional sucker rods. Simultaneously, using hollow sucker rods creates a premise to condition wellbore fluids while pumping the well (through injecting the conditioning fluid through the hollow sucker rods) still using the infrastructure and logistics available on site to handle traditional sucker rods. In the case of PC pumping technology, using hollow sucker rods creates a premise to condition the wellbore ortwet1hsreservoir rock without pulling the sucker rods string out the well. Thus, there is an immediate advantage of using hollow sucker rods for wells already equipped with PCP. Plunger pumping as well as screw pumping technologies will also benefit using the hollow sucker rods and conditioning method.

Live data gathering as well as PCPs, screw pumps or ESPs direct drive applications will benefit from using hollow sucker rods. Information from bottom hole transducers can now be transmitted to surface via adequate electric or optical data cables inserted through the hollow sucker rod string, while pumping the well. When direct drive applications are considered, one has to bear in mind that electric motors have to be attached directly to the pump, downhole. If hollow sucker rods technology considered, the power can be brought and delivered to the bottom hole electric motor via power cables inserted into the hollow sucker rod string. Data and power cables protection can thus become lighter since no need for cables to stand the aggressivity of the wellbore fluids or combined effect of temperature or pressure, thus the cost of these special cables dropping. Bottom hole live data gathering or direct drive becomes more attractive and easier to implement.

BRIEF DESCRIPTION OF THE DRAWING

Examples depicting the conditioning method presented in this application and the hollow sucker rods devised for it are described below with reference to the drawing in which.

SPECIFIC DESCRIPTION

Figure 1:
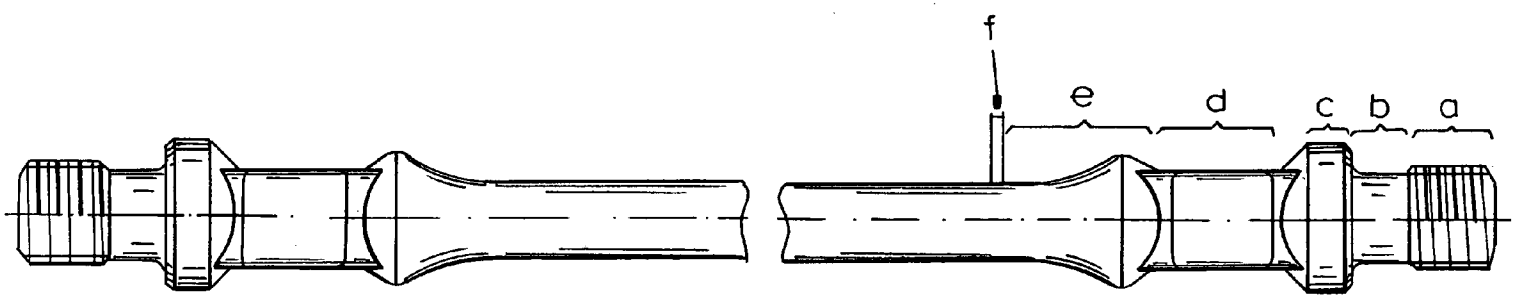
FIG. 1 shows a front view of a hollow sucker rod.
Figure 2:
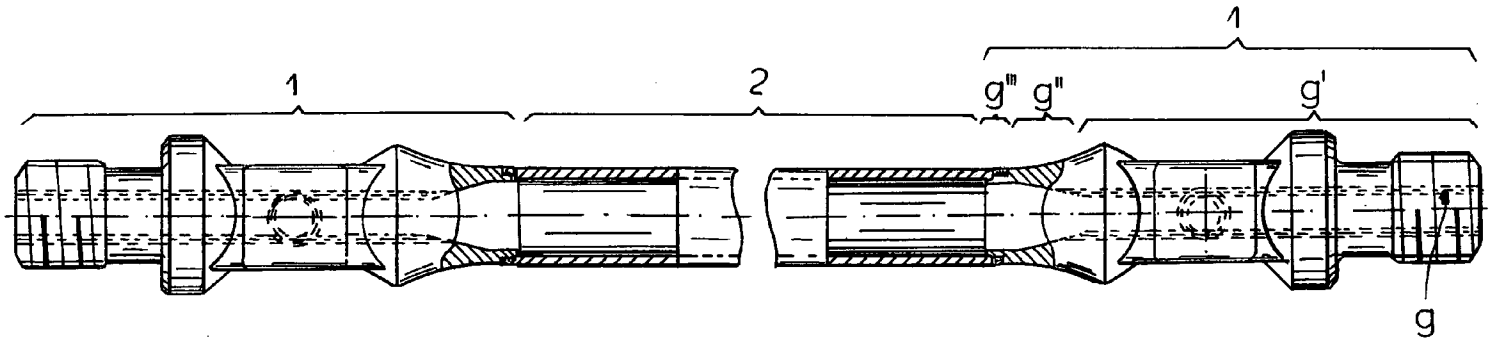
FIG. 2 shows a front view & partial resection of hollow sucker rod from FIG. 1.

The conditioning method of the present application involves the preparation of conditioning fluid, dosing and pumping it into the wellbore while producing the well, causing the conditioning fluid to interact with wellbore fluids, the wellbore itself or the reservoir rock and changing accordingly the properties of wellbore fluids or reservoir rock around the wellbore. Specific to the method is the pumping phase of the conditioning fluid. The conditioning fluid flows directly into the wellbore, through the hollow sucker rods, concomitantly with pumping wellbore fluids to surface. Transmitting the power needed for pumping from surface to the point of use (the downhole pump) concomitantly with conditioning the wellbore fluids becomes thus possible through this new approach. Conditioning fluid that is pumped into the wellbore through the hollow sucker rods can be directed into the production tubing or the wellbore while pumping the well, or can be injected into the reservoir rock around the wellbore without pulling out the hollow sucker rods string. Adjusting the injection pressure and using adequate fluid diverting devices controls the place where the conditioning fluid is disbursed into the wellbore. All conditioning and pumping phases are done traditionally.

The shape and size of hollow sucker rod as devised through the present invention follow API 11B standard. The hollow sucker rod consists of two tubular pieces 1 named sucker-rod head attached to a steel tube 2. Wall thickness of the steel tube is sized adequately to serve the process. Attaching sucker-rod heads to steel tube is by welding, thus obtaining as the final product, a continuous tube through which fluid can flow, the hollow sucker rod. Assembling hollow sucker rods together results into a hollow sucker rod string that can transmit power from the surface to the point of use (the downhole pump). Concomitantly allowing fluid to flow through it. The length of hollow sucker rods is between 8.32 meters and 9.99 meters, shorter versions ("hollow pony rods") being possible to be made through same process (the equivalent of pony rods from API 11B).

The sucker-rod head 1 consists of a threaded pin section a (thread as per API 11B), that continues with a section b that serves as a stress relief section, followed by section c or shoulder, followed by a wrench square" d. Wrench square d allows the application of torque, via a wrench, when assembling/dis-assembling hollow sucker rods into a string. Wrench square d continues with a thicker section e, called "bead", and a welding section f, which is cylindrical. Inner hollow g of the sucker rod head 1 is cylindrical through out section g', from top end of threaded pin all along last third of the "bead" e, continues conical through out section g" and terminates with another cylindrical section g"' through out the welding section f Between section g" and g"' a radius r is allowed, to act as a stress relief section. The steel the hollow sucker rod is made of is selected such that all prerequisites in terms of torque, elongation and combined torque and elongation should be fulfilled, including fatigue and corrosion resistance.

Figure 3:
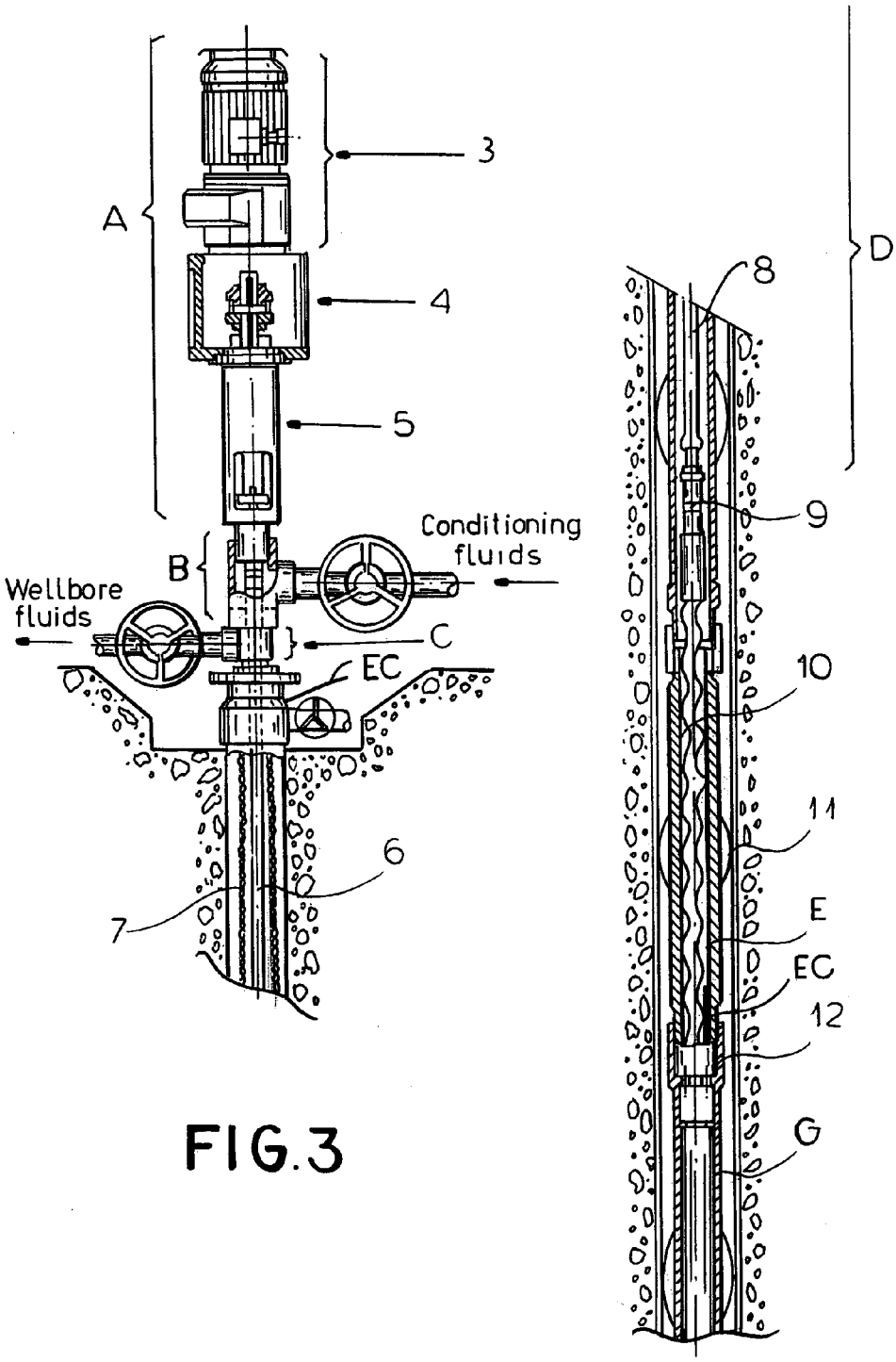
FIG. 3 shows a schematic view of a typical PCP pumping arrangement using a hollow sucker rods string.

Hollow sucker rod can be assembled into a hollow sucker rods string and this is presented in FIG. 3 for a typical PCP application. One can see that the pumping unit consists of a drive unit A, made of an electrical motor 3 delivering power to a gear box, a coupling 4 and a drive head 5. Stuffing box B on the hollow polished rod 6 insures that injection fluid can be pumped through the hollow sucker rod string without leaking. Stuffing box C seals the hollow polished rod 6 against the production tubing, such that no wellbore fluids spill into the environment. Hollow polished rod 6 connects to the hollow sucker rod string D via a shorter hollow sucker rod, similar to a pony rod but hollow. Hollow sucker rod string D inserts into the production tubing 7 and is made of hollow sucker rods 8 connected together via standard threaded connectors. Hollow sucker rod string can be terminated with an injection valve 9, through which conditioning fluid can be disbursed in the annulus between the production tubing and the sucker rod string, above the PCP pump. Power is transmitted from surface to the PCP pump E via the hollow sucker rod string D. PCP pump E can be either traditional or hollow rotor PCP. Anchor F and stabilizer 11 anchors and centers the PCP downhole. In this later case conditioning fluid can be disbursed either in the production tubing or downhole into the wellbore while pumping the well. Reservoir rock around the wellbore can also be conditioned if when conditioning fluid injected via hollow sucker rod string.

If live data gathering is to be considered, data cables transmitting information from downhole transducers to surface run through the hollow sucker rod string. Data cables, either electric or optical, are thus protected against the aggressivity of the wellbore fluids and the impact of pressure. Similarly, when direct drive applications considered the power cable runs through the hollow sucker rod string, connecting electric motor downhole to surface power.

When a plunger pump considered the PCP pump E has to be replaced with a downhole plunger pup, and the drive unit with a pump jack, the rest of the configuration staying the same. In the case of a "screw" pump the PCP pump E is replaced by the screw pump itself, no other changes being necessary to configuration presented in FIG. 3. In both cases (downhole plunger pump and "screw" pump) one can condition the wellbore fluids while pumping, injecting conditioning fluid through the hollow sucker rod string D into annulus between production tubing and hollow sucker rod string, through injection valve 9, above the pump. Because of the way these pumps are designed, conditioning the wellbore or the reservoir rock around the wellbore through injecting conditioning fluid through hollow sucker rod string is no longer possible.

The invention claimed is:

1. In combination: a sucker rod for a wellbore having a downhole pump and adapted to introduce a conditioning fluid during production pumping of a well, the sucker rod being assembled into a hollow pumping string and being made of steel, profiled and threaded at both ends, the sucker rod comprising two sucker rod heads that are tubular, welded to the ends of a tube made of steel, thus forming a continuous tube through which the conditioning fluid can flow and an electric or optical cable can be pulled through, or set inside, each head having an inner hole of cylindrical section from a top end of the sucker rod thread down to approximately the lower end of an upset bead of the head of the sucker rod, the cylindrical section being followed by a conical section and ending with another cylindrical section extending all the way through a welding zone of the head of the sucker rod, between the conical section and the cylindrical section there being provided a radius that works as a stress relief:

a hollow rotor of a progressive-cavity pump, used to pump the well concomitantly with injecting conditioning fluids; and electrical/optical cables passing through the string, the cables transmitting to the surface signals about properties of the wellbore fluids or pump status, signals generated by adequate transducers mounted on the sucker rod string or pump, or transmitting power from the surface to downhole electrical motors used to drive progressive-cavity-pump, screw or electrical-submersible pumps.

2. In combination:

a hollow progressive-cavity-pump pumping string made of steel and comprising a progressive-cavity-pump rotor which is hollow, made of steel, assembled together with a train of hollow sucker rods, each sucker rod being made of steel, profiled and threaded at both ends and, having two sucker rod heads which are tubular, welded to the ends of a tube made of steel, thus forming a continuous tube connecting the surface to a wellbore through which a fluid can flow or an electric or optical cable can be pulled through or set inside;

means for injecting conditioning agents; and electrical/optical cables passing through the string and including electrical cables that transmit to the surface the electrical signals about properties of the wellbore fluids or pump status, generated by adequate transducers mounted on the sucker rod string or pump itself, or that transmit power from the surface downhole to the downhole electrical motors used to drive progressive-cavity-pump, screw or electrical-submersible-pump pumps.

3. An oil-well system comprising:

a production tubing in a wellbore extending from a surface to an oil production location;

a downhole pump along said tubing having a driven member displaceable to force wellbore fluids upwardly through said tubing;

a sucker rod string in said production tubing and comprised of a plurality of sucker rods connected end to end and connected to said member for driving same, each of said sucker rods having:

respective heads at an upper end and a lower end, each head being formed with a threaded portion, followed by a constricted relief portion, followed by a shoulder, followed by a square cross section wrench portion, followed by a bead portion along an exterior of the respective head, and a steel tube welded to each of the bead portions of the respective sucker rods, said heads internally being formed with cylindrical bores running from each end to the respective bead portion, a conically widening passage extending from the respective cylindrical bore toward said tube, and a cylindrical bore connecting each passed with said tube, said sucker rod string forming a clear passage from a top to a bottom thereof;

an injection valve at the bottom of said sucker rod string for discharge of a conditioning fluid into said wellbore fluids, into said wellbore and into structures around said wellbore;

an above-ground motor connected to said sucker rod string for displacing same to drive said member; and a stuffing box and an inlet for supplying the conditioning fluid to said clear passage of said sucker rod string at said top thereof.

* * * * *